United States Patent [19]

Kubo

[11] Patent Number: 4,738,000

[45] Date of Patent: Apr. 19, 1988

[54] BOWLING LANE MAINTENANCE APPARATUS

[76] Inventor: Chikanari Kubo, 7-2-101, Shin-Isono 4-chome, Sagamihara City, Kanagawa Pref., Japan

[21] Appl. No.: 871,796

[22] Filed: Jun. 9, 1986

[51] Int. Cl.[4] ..... A47L 11/40

[52] U.S. Cl. ..... 15/98; 15/49 R

[58] Field of Search ..... 15/49 R, 98, 4, 51, 15/52

[56] References Cited

U.S. PATENT DOCUMENTS

| | | | |
|---|---|---|---|
| 3,150,395 | 9/1964 | Lucky | 15/98 |
| 3,216,036 | 11/1965 | Rockwood et al. | 15/98 |
| 4,137,591 | 2/1979 | Baker | 15/98 |
| 4,246,674 | 1/1981 | Ingermann et al. | 15/98 X |

*Primary Examiner*—Donald Watkins

*Attorney, Agent, or Firm*—Andrus, Sceales, Starke & Sawall

[57] ABSTRACT

The present invention provides a bowling lane maintenance apparatus moving on a bowling lane along the length thereof to effect a maintenance and thereafter traversing to the adjacent bowling lane across a division capping therebetween to effect a similar maintenance, the maintenance apparatus including a body, a first link pivotally connected at one end with the body and spring-biased in one direction, the first link having a relatively long length, a second link pivotally connected with the other end of the first link and spring-biased in the same direction, the second link having a length smaller than that of the first link, a roller rotatably mounted on the end of the second link opposite to the first link and a detection mechanism on the first and second links for detecting a relative position between the first and second links.

1 Claim, 3 Drawing Sheets

BOWLING LANE MAINTENANCE APPARATUS

BACKGROUND OF THE INVENTION

Field of the Invention

The present invention relates to a bowling lane maintenance apparatus moving on the bowling lane along the length thereof to effect a maintenance and thereafter traversing to the next bowling lane across a division capping therebetween to effect a similar maintenance and more particularly a detecting mechanism for a lane dividing end cap (also called a division capping end herein) for stopping such a maintenance apparatus on the adjacent bowling lane in place.

The traversing motion of the bowling maintenance is required by a single maintenance apparatus which is adapted to clean and condition a number of bowling lanes in a continuous manner. The dimensions of a bowling lane is standardized to hold the same distance between the division capping ends of each adjacent bowling lanes. Thus, the traversing maintenance apparatus can sense the division capping end of a bowling lane to stop at the exact center of the adjacent bowling lane.

In the prior art, the detection of such division capping ends has been made by means of a pendulum type detector. More particularly, the bowling maintenance apparatus comprises a body on which a pendulum is mounted in a plane perpendicular to the length of bowling lanes. A distance between the surface of the bowling lane and the lower extremity of the pendulum is designed to be smaller than a distance between the surface of the bowlng lane and a division capping end of the same. When the maintenance apparatus is transversely moved from one bowling lane to the adjacent bowling lane, the pendulum is engaged at its lower extremity by the division capping and inclined about its fulcrum while moving on the division capping. The pendulum is disengaged from the division capping at its end face and then returned to the vertical position of the pendulum. The body also comprises a micro-switch for sensing the vertical position of the pendulum. When the pendulum is disengaged from the division capping end and swung to its vertical position, the micro-switch is actuated by the pendulum to detect the position of the division capping end.

If the height of the division capping end from the bowling lane is varied, however, such a pendulum type detector cannot detect the exact position of that division capping end due to the varied timing at which the pendulum is moved away from the top of the division capping.

SUMMARY OF THE INVENTION

It is therefore an object of the present invention to overcome the above problem in the prior art and to provide a bowling lane maintenance apparatus comprising an improved lane dividing end cap detection mechanism which can detect the exact position of a division capping end to properly position the maintenance apparatus on the adjacent bowling lane in place, independently of variations of the height of the division capping end.

To this end, the present invention provides a bowling lane maintenance apparatus moving on a bowling lane along the length thereof to effect a maintenance and thereafter traversing to the adjacent bowling lane across a division capping therebetween to effect a similar maintenance, the maintenance apparatus comprising a body, a first link pivotally connected at one end with said body and spring-biased in one direction, said first link having a relatively long length, a second link pivotally connected with the other end of said first link and spring-biased in the same direction, said second link having a length smaller than that of said first link, a roller rotatably mounted on the end of said second link opposite to said first link, a detection mechanism on said first and second links for detecting a relative position between said first and second links, whereby said detection mechanism can sense the separation of the roller on said second link from the division capping end to detect the position thereof, and a timer mechanism for transversely moving the maintenance apparatus across the division capping end and stopping it on the adjacent bowling lane in place.

DESCRIPTION OF PREFERRED EMOBODIMENT

Figure 2:
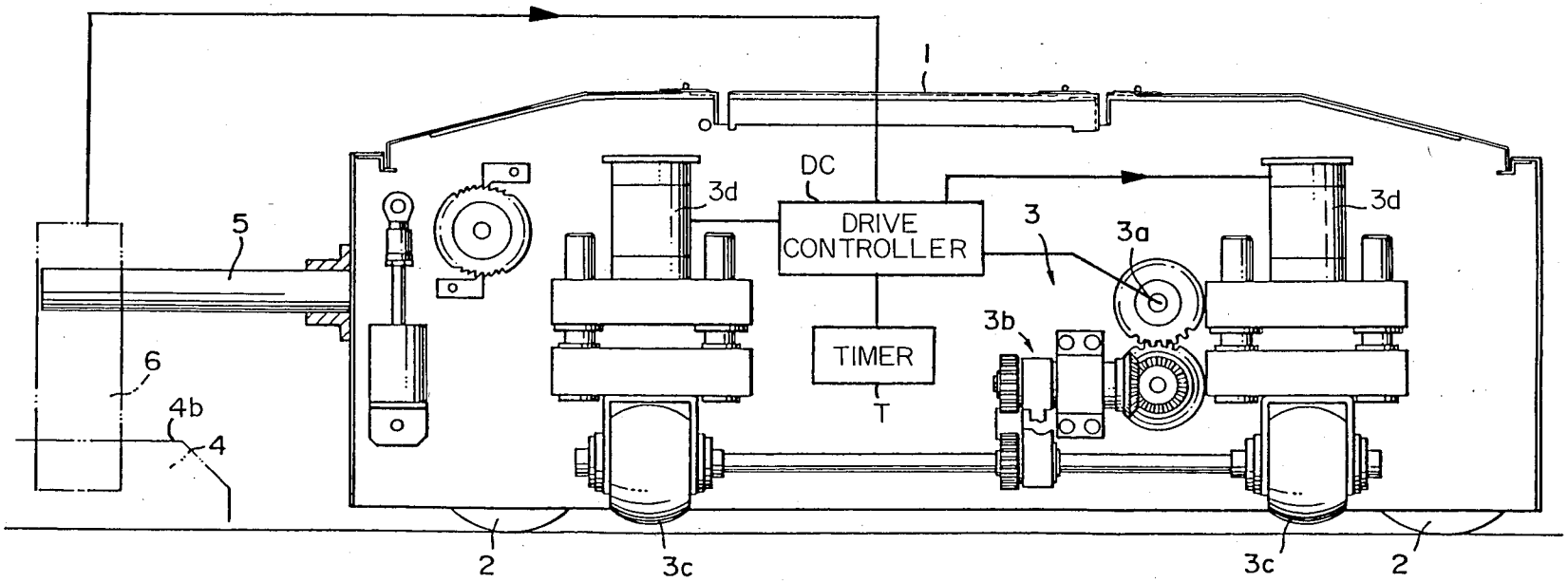
FIG. 2 is a schematic side view of a bowling lane maintenance apparatus into which a division capping end detection mechanism according to the present invention is incorporated.

Referring first to FIG. 2, there is shown a bowling lane maintenance apparatus comprising a body 1 which is adapted to move on a bowling lane between the foul line and the pin zone and then back to the foul line to effect a maintenance for the bowling lane when longitudinally driving wheels 2 thereon are driven. The body 1 is subsequently moved to the adjacent bowling lane across a lane dividing end cap or division capping 4 between the bowling lanes by a traversing mechanism 3 to effect a similar maintenance for the adjacent bowling lane.

The traversing mechanism 3 comprises a drive motor having its output shaft *3a* drivingly connected, through a gear train *3b*, with traversing wheels *3c* which are rotatably disposed on the body to roll in a direction perpendicular to the direction in which the division capping 4 extends. When the body 1 is being moved along the length of the bowling lane, the traversing wheels *3c* are held spaced above the lane at a level above the longitudinally driving wheels 2. When the body 1 is transversely moved across the division capping 4, the traversing wheels *3c* are shifted downwardly below the longitudinally driving wheels 2 by actuation of air cylinders *3d*. Thus, the traversing wheels *3c* are brought into contact with the surface of the bowling lane and at the same time raise the body 1 and thus the longitudinally driving wheels 2 away from the bowling lane.

The body 1 further comprises a telemeter not shown and a drive controller DC. The longitudinal and transverse movements of the body 1 can be controlled by the drive controller depending on various input signals thereto, such as signals indicative of the distance between the foul line and the pin zone, maintenance data including the number of bowling lanes to be cleaned and conditioned, signals from a division capping end detection mechanism 6 on the distal end of a supporting rod 5 rigidly mounted on the forward face of the body 1, signals from the telemeter and so on.

Figures 1A, 1B:
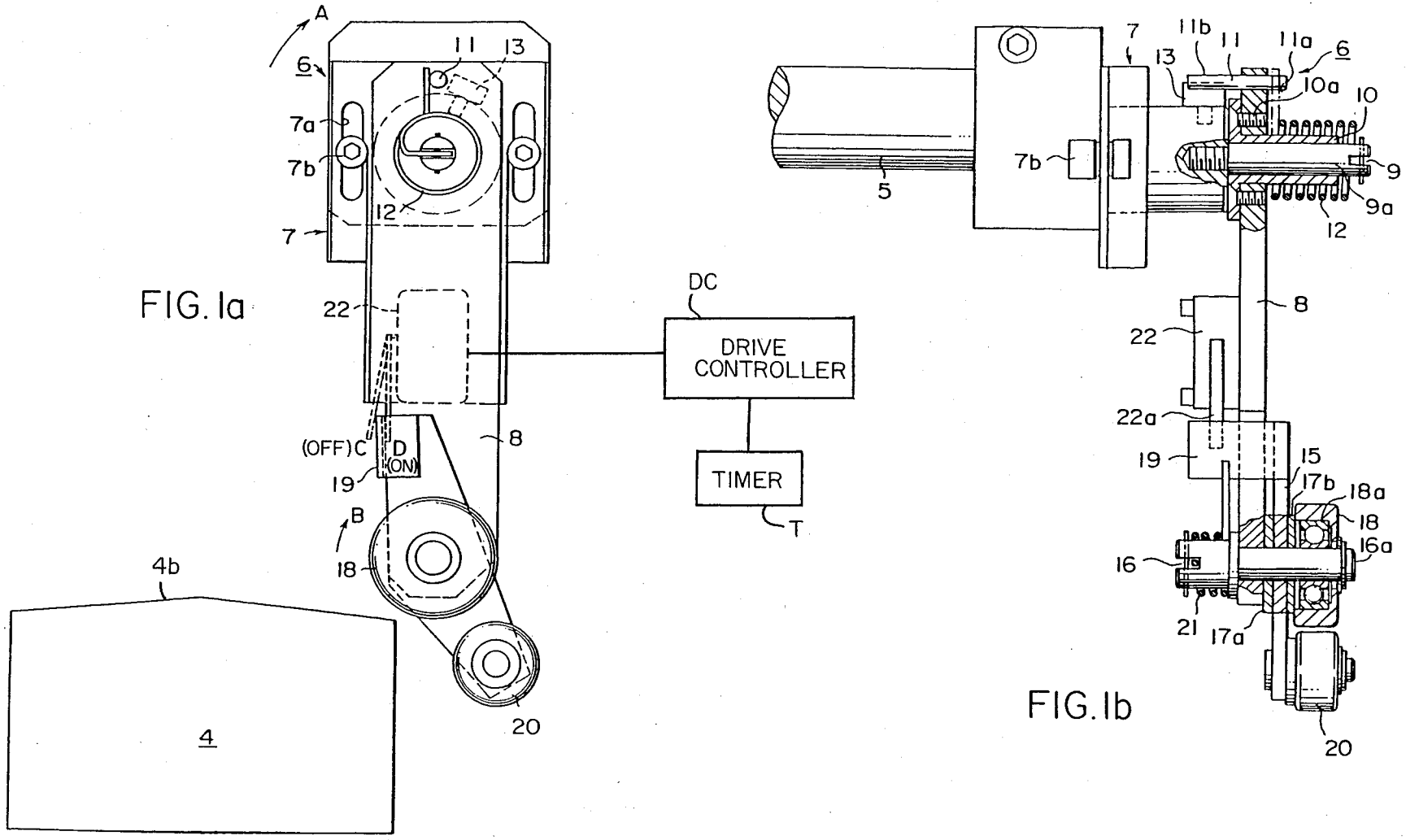
FIG. 1A is a front elevational view of a preferred embodiment of a division capping end detection mechanism constructed in accordance with the present invention.
FIG. 1B is a side elevational view, partially broken away, of the detection mechanism shown in FIG. 1A.

Referring now to FIGS. 1A and 1B, the lane dividing end cap detection mechanism 6 is shown as is connected with the supporting rod 5 of the body 1 through a supporting member 7. The supporting member 7 includes a slot 7a which slidably receives a screw 7b. When the position of the screw 7b is changed within the slot 7a, the height of the capping end detection mechanism 6 above the surface of the bowling lane can be adjusted depending on the height of the division capping 4.

A first link 8 is rotatably and pivotally supported at its upper end on the side of the supporting member 7 opposite to the supporting rod 5 in a plane perpendicular to the length of the division capping 4. More particularly, the supporting member 7 threadingly receives a supporting screw 9a having a head in which a groove 9 is formed. A hollow sleeve 10 is joined to the first link 8 by means of machine screws 10a and disposed about the supporting screw 9a. A pin 11 extends through the first link 8 and rigidly mounted thereon. A biasing torsion spring 12 is operably located between the end 11a of the pin 11 remote from the supporting member 7 and the groove 9 in the supporting screw 9a and biases the first link 8 in a direction shown by arrow A in FIG. 1A in a plane perpendicular to the length of the division capping 4. The supporting member 7 includes a stopper 13 on the side thereof, which is adapted to limit the lateral motion of the end 11b of the pin 11 adjacent the supporting member 7. Therefore, the first link 8 is positioned at its vertical position when the pin 11 is engaged by the stopper 13.

A second link 15 is pivotally supported generally intermediate its ends by the other or lower end of the first link 8. More particularly, a supporting pin 16a extends through the first link 8 and has a head formed with a groove 16. The midportion of second link 15 is fitted over the supporting pin 16a between a pair of spacers 17a and 17b at the side of the supporting pin 16a remote from the supporting member 7. The outer end of the supporting pin 16a supports a bearing 18a on which a roller 18 is rotatably supported.

The second link 15 includes an arm member 19 formed thereon at one end, the arm member 19 extending through the first link 8 toward the supporting member 7. The second link 15 also includes a roller 20 rotatably supported on the end of the second link 15 opposite to the arm member 19 and on the side of link 8 remote from member 7.

On the side of the supporting pin 16a facing toward the supporting member 7, a biasing torsion spring 21 is located about the supporting pin 16a between the groove 16 of the supporting pin 16a and the arm member 19 of the second link 15. The torsion spring 21 biases the second link 15 about the supporting pin 16a in a direction shown by arrow B in FIG. 1A.

The first link 8 includes a micro-switch 22 located thereon on the side facing toward the supporting member 7. The micro-switch 22 has a switch arm 22a adapted to engage the arm member 19 on the second link 15. Upon pivotal movement of the second link, the switch arm 22a is actuated to position the micro-switch at its OFF position C or its ON position D. Output signals of the micro-switch 22 are supplied to the controller in the body 1.

Figure 3B:
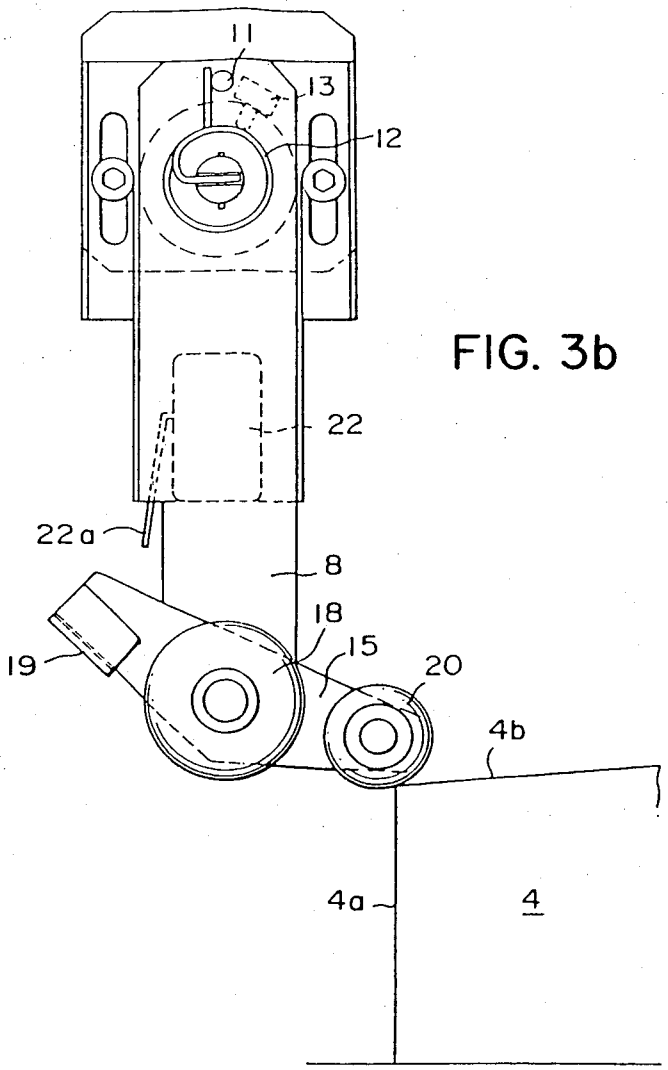
FIGS. 3A and 3B illustrate the operation of the division capping end detection mechanism shown in FIG. 1.
Figure 3A:
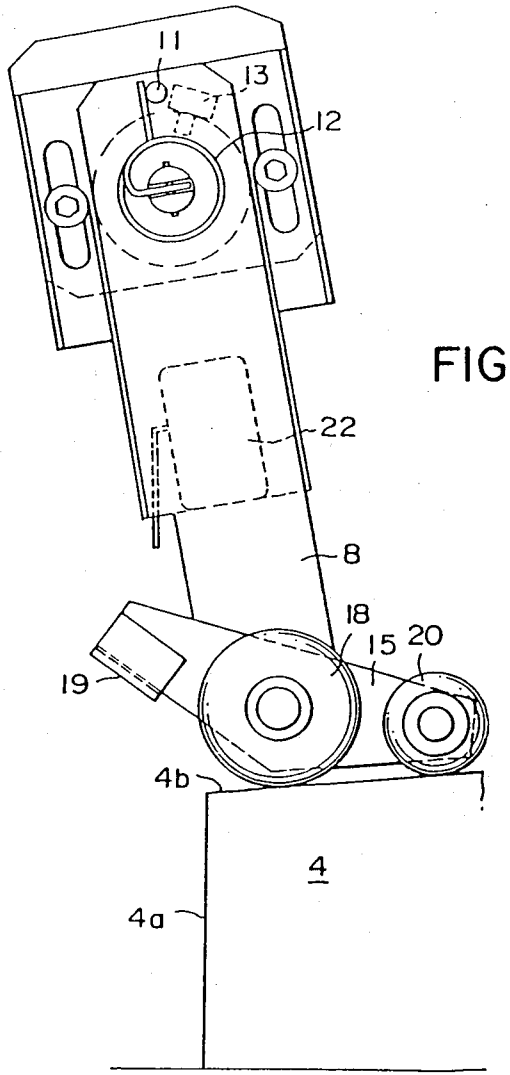

Referring to FIGS. 3A and 3B, there is shown the detection mechanism 6 of FIG. 1A after the maintenance apparatus body 1 drive has completed the maintenance for one bowling lane. The drive controller then operates to actuate the air cylinders 3d to move the traversing wheels 3c downwardly and thus to move the longitudinally driving wheels 2 upwardly away from the bowling lane. The traversing mechanism 3 is then actuated to rotate the traversing wheels 3c to move the body 1 transversely. The height of the capping end detection mechanism 6 is previously adjusted via screw 7b in slot 7a such that the roller 18 can engage the edge of the end face 4a of the division capping 4. On the traversing motion of the body 1, therefore, the roller 18 is engaged by the edge of the capping end 4a to rotate the first link 8 counter-clockwise against the force of the torsion spring 12. Thus, the roller 18 will ride on the top capping face 4b beyond the edge of the capping end face 4a. At this time, the micro-switch 22 is turned off. As the body 1 further moves transversely, the roller 20 causes the second link 15 to rotate counter-clockwise against the action of the torsion spring 21 and then rides on the top capping face 4b. Although the top capping face 4b, as in FIG. 3A is variable in height, the rollers 18 and 20 will not be separated from the top capping face 4b but only be shifted to change the inclined angles of the first and second links 8 and 15, as shown in FIG. 3A. As the body 1 further moves transversely, the roller 18 is separated from the edge of the capping end face 4a while the roller 20 is still on the top capping face 4b at a boundary between the top capping face 4b and the capping end face 4a, as shown in FIG. 3B. Thus, even if the height of the edge of the capping end 4a above the surface of the bowling lane is variable, the timing of the roller 20 when separated from the capping end face 4a is invariable since only the inclined angles of the first and second links is changed and the height of the roller 20 can freely be selected.

As the roller 20 is separated from the capping, the first link 8 is held at its vertical position by engagement of the pin 11 with the stopper 13. The arm member 19 on the second link 15 is thus rotated clockwise under the action of the torsion spring 21 to shift the switch arm 22a of the micro-switch 22 from its OFF position to its ON position such that the position of the division capping end face 4a will be detected. Detection signal is supplied to the drive controller to actuate a timer mechanism T for determining time required to move the body 1 from the division capping end 4a to a predetermined position on the adjacent bowling lane. On passage of a predetermined period, the timer mechanism then generates a stop signal which in turn is supplied to the drive controller to stop the body 1 on the adjacent bowling lane in place.

As can be apparent from the foregoing, the present invention provides a capping end detection mechanism for use in a bowling lane maintenance apparatus, which comprises a body, a first link pivotally mounted on the body and spring-biased in one direction, the first link having a relatively long length, a second link pivotally mounted on the end of the first link and spring-biased in the same direction, the second link having a length smaller than that of the first link, a roller rotatably mounted on the distal end of the second link, the roller being rolled on the top face of a division capping between each adjacent bowling lanes against the influences of the springs biasing the first and second links and then separated from the top capping face to detect the position of the division capping end. Thus, ever if the height of the capping end face is variable, the roller can freely be shifted upwardly or downwardly while rolling on the capping. Since the roller can be separated from the capping at the exact position of the capping end, the position of the capping end can exactly be detected.

I claim:

1. In a bowling lane maintenance apparatus for maintaining a plurality of longitudinally extending bowling lanes provided with lane dividing end cap means (4) therebetween which have variable height top surfaces (**4*b***), the combination comprising:

(a) a body (1), (b) driven wheel means (2) mounted to said body for moving said body longitudinally along a bowling lane, (c) normally retracted traversing wheels (**3*c*) mounted to said body for moving said body transversely between adjacent lanes, (d) means (3*d*) for lowering said traversing wheels into engagement with a lane so that said driven wheel means are lifted out of contact with the lane and to raise said body upwardly, (e) a drive controller (DC) for actuating said traversing wheels for a timed period, (f) and detection means (6**) disposed outwardly of said body and engageable with the variable height top surface of an end cap means and connected to actuate said drive controller, said detection means comprising:

(1) a supporting member (7) connected to said body, (2) a first link (8) having upper and lower ends and pivotally mounted at its upper end to said supporting member for pivotal movement transverse of a bowling lane and an adjacent end cap means, (3) first spring means (12) for biasing said first link in a given direction to a normally vertical position, (4) a first roller (18) mounted to the lower end of said first link and with said first roller being engageable with the said variable height top surface (**4*b*) of a said end cap means to pivot said first link against the biasing force of said first spring means, (5) a second link (15) shorter than said first link and pivotally mounted intermediate its upper and lower ends to the lower end of said first link, (6) second spring means (21) for biasing said second link in the same given direction as said first link, (7) a second roller (20) mounted to the lower end of said second link and with said second roller being engageable with the said variable height top surface (4*b*) of a said end cap means to pivot said second link against the biasing force of said second spring means to a pivoted position relative to said first link, (8) and means (19, 22, 22*a***) on said first and second links and connected to said drive controller to actuating said controller in response to the pivoted positions of said first and second links.

* * * * *